United States Patent [19]

Bringhurst

[11] Patent Number: 4,584,937

[45] Date of Patent: Apr. 29, 1986

[54] LONG RELEASE COIL HAMMER ACTUATING MECHANISM

[75] Inventor: Edward D. Bringhurst, Seattle, Wash.

[73] Assignee: Mannesmann Tally Corporation, Kent, Wash.

[21] Appl. No.: 730,252

[22] Filed: May 3, 1985

Related U.S. Application Data

[63] Continuation of Ser. No. 558,975, Dec. 7, 1983, abandoned.

[51] Int. Cl.[4] ..... B41J 3/02

[52] U.S. Cl. ..... 101/93.04; 101/93.48; 400/121

[58] Field of Search ..... 101/93.04, 93.16, 93.48, 101/93.29, 93.32, 93.33, 93.34; 400/121, 124, 157.2, 163.1

[56] References Cited

U.S. PATENT DOCUMENTS

| | | | |
|---|---|---|---|
| 4,190,847 | 2/1980 | Stenudd | 400/124 X |
| 4,233,894 | 11/1980 | Barrus et al. | 101/93.04 |
| 4,351,235 | 9/1982 | Bringhurst | 101/93.04 |
| 4,393,771 | 7/1983 | Tatsumi | 101/93.48 |
| 4,438,692 | 3/1984 | Yanadori et al. | 400/157.2 X |
| 4,503,768 | 3/1985 | Whitaker | 101/93.04 |
| 4,509,421 | 4/1985 | Kurihara et al. | 101/93.04 |

FOREIGN PATENT DOCUMENTS

| | | | |
|---|---|---|---|
| 2920732 | 12/1979 | Fed. Rep. of Germany | 101/93.04 |
| 47912 | 12/1979 | Fed. Rep. of Germany | 101/93.04 |

OTHER PUBLICATIONS

IBM Technical Disclosure Bulletin, "Solenoid Structure Having Enhanced Force" vol. 22, No. 5, Oct. 1979, p. 1744 by McCarty.

*Primary Examiner*—Charles A. Pearson

*Attorney, Agent, or Firm*—Christensen, O'Connor, Johnson & Kindness

[57] ABSTRACT

An actuating mechanism includes a magnetic circuit formed by a permanent magnet (43), a flux plate (45), a return plate (47), a post (49), and a long release coil (51). The outer end of the release coil (51) terminates slightly short of the tip of the post. Further, the post (49), long coil (51), flux plate (45) and return plate (47) are sized and positioned such that the tip of the post (49) lies coplanar with the outer surface of the return plate (47) and such that the end of the return plate (47) terminates just short of the release coil (51). The head (59) of a hammer (53) is positioned to be attracted to the post tip by the magnetic flux created by the permanent magnet (43). The permanent magnet attraction force bends the head (59) of the hammer (53) across the small gap resulting in the hammer (53) being cocked. When the long release coil (51) is energized, it produces a magnetic field that counteracts the permanent magnet attraction force, releasing the cocked hammer. Release of the cocked hammer impacts a ball (61), welded to the side of the hammer (53) remote from the pole tip, against a ribbon to create a dot on a print-receiving medium. Because the release coil (51) terminates just short of the tip of the post (49), the intensity of the flux produced by the coil (51) at the interface between the post tip and the hammerhead (59) is high.

2 Claims, 3 Drawing Figures

LONG RELEASE COIL HAMMER ACTUATING MECHANISM

This application is a continuation application based on prior copending application Ser. No. 558,975, filed Dec. 7, 1983, now abandoned.

TECHNICAL FIELD

This invention relates to actuating mechanisms and, in particular, actuating mechanisms for printers, specifically dot matrix printers.

BACKGROUND OF THE INVENTION

In general, dot matrix printers can be separated into two categories—dot matrix line printers and dot matrix serial printers. Both categories of printers create images (characters or designs) by selectively printing a series of dots in an X-Y matrix. Dot matrix serial printers include a print head that is moved horizontally back and forth across a sheet of paper, either continuously or in steps. The print head includes a vertical column of dot printing elements. As each column position of a character position is reached during printing, the required number of dot-printing elements are actuated to form dots. A series of thusly created vertical dot columns forms the desired character. Contrariwise, dot matrix line printers include a dot-printing mechanism for creating horizontal lines of dots substantially simultaneously as the paper is stepped through the printer. A series of horizontal lines of dots creates an image, i.e., a row of characters or a design. While the present invention may find use in other areas, because it was designed for use in a dot matrix line printer, it is described in connection with such a printer.

In the past, various types of actuating mechanisms for use in dot matrix line printers have been proposed and implemented. U.S. patent application Ser. No. 512,470, filed July 11, 1983, entitled "Single-Piece Hammer Module," and assigned to the assignee of the present application, describes an actuating mechanism for a dot matrix line printer. The actuating mechanism is incorporated in hammer modules that include a plurality of cantilevered print hammer arms formed of a resilient ferromagnetic material. Mounted on the end of each print hammer arm is an anvil (e.g., a ball) that prints a dot when the associated hammer arm is actuated. Each hammer actuation mechanism comprises a permanent magnet, a post and plates that create a magnetic path between the permanent magnet and the post plus a release coil mounted on the post. In the absence of current through the release coil, the print hammer arm is attracted to the post by the magnetic field produced by the permanent magnet. The attraction stresses the hammer arm. The thusly cocked hammer arm is released by energizing the release coil such that the coil produces a magnetic field that counteracts the magnetic post attraction field created by the permanent magnet. When released, the stored energy resulting from stressing a resilient hammer arm causes the hammer to impact the anvil against a ribbon and create a dot on a print receiving medium.

While dot-printing mechanisms of the type generally described above have a number of advantages over previously developed dot-printing mechanisms for use in dot matrix line printers and, thus, form a significant step forward in this art, it has been found that such dot-printing mechanisms can be improved. In this regard, as discussed above, the hammers of the abovedescribed dot-printing mechanisms are released when a suitable current passes through a release coil. While a hammer is released when current of suitable magnitude and direction passes through a release coil, the magnetic field produced by the current flow does not fully counteract the magnetic field produced by the permanent magnet. Rather, the magnetic field of the permanent magnet is only counteracted to the degree necessary for the stress force stored in the hammer to overcome the permanent magnet attraction force. As a result, after release, the permanent magnet produces a magnetic field that creates a "drag" force on the released hammer. This drag force reduces the impact force applied by the hammer to the anvil. One obvious way of reducing the amount of permanent magnet drag force is by increasing the magnitude of the current applied to the release coil. In many printers this approach is unacceptable because increasing release coil current increases the amount of heat generated by the coil, which may result in the premature destruction of the coil. While the heat problem, to some extent, can be compensated by adding or increasing the capacity of an existing cooling mechanism, this approach increases the cost and complexity of the overall printer.

This invention is directed to increasing hammer force for a given amount of current without increasing the magnitude of the current applied to the release coil. Conversely, for a given level of hammer force, this invention is directed to reducing the magnitude of the current applied to the release coil.

SUMMARY OF THE INVENTION

In accordance with this invention an improved actuating mechanism for a cantilever-mounted hammer, suitable for use in a dot matrix line printer, is provided. The actuating mechanism includes a magnetic circuit formed by a permanent magnet, a flux plate, a return plate, a post and a release coil. The flux and return plates lie in parallel planes located on opposite sides (poles) of the permanent magnet and extend outwardly therefrom in the same direction. The post is mounted on the end of the flux plate and the release coil is mounted on the post. The coil terminates slightly short of the tip of the post. In actuating mechanisms having relatively short posts, preferably, the release coil extends from the flux plate to the tip of the post. Such a coil is herein referred to as a long coil to distinguish it from prior art release coils that terminate well prior to the tip of even short posts. The post, flux plate and return plate are sized and positioned such that the tip of the post lies coplanar with the outer surface of the return plate arm and such that the end of the return plate arm terminates just prior to reaching the adjacent periphery of the release coil mounted on the post. The fixed end of the cantilever-mounted hammer is attached to the outer surface of the return plate in alignment with the permanent magnet. The head of the hammer is positioned to be attracted to the post tip and the adjacent area of the return plate by the magnetic flux created by the permanent magnet when the release coil is not energized. The attraction force pulls the head of the hammer across a small gap, stressing and, thereby, cocking the hammer. When the release coil is energized, it produces a magnetic field that counteracts the permanent magnet attraction field, releasing the cocked hammer. Release of the cocked hammer impacts an anvil (e.g., a ball), welded to the side of the hammer remote from the pole tip, against a ribbon to create a dot on a print-receiving medium. Because the coil extends almost to the tip of the coil post, the intensity of the flux produced by the coil at the interface between the post tip and the hammerhead for a given level of release current is high. It is the maximization of flux intensity at this interface that reduces the amount of drag force created by the permanent magnet after the hammer is released for a given level of release current or allows the release current to be decreased for a given magnitude of hammer impact force.

In summary, the invention provides a release coil mounted on a post of a hammer actuating mechanism such that the end of the coil is much nearer to the tip of the post than it has been in prior hammer actuating mechanisms of the type described in U.S. patent application Ser. No. 512,470, referenced above. As a result, the intensity of the magnetic flux produced by the coil at the tip of the post for a given level of coil current is increased when compared to prior hammer actuating mechanisms where the coil has been spaced a significant distance from the tip of the post. Because magnetic flux intensity at the interface between the post tip and the hammerhead is increased, the amount of permanent magnet drag force applied to the hammerhead after release is substantially reduced for a given magnitude of current. Consequently, the amount of print force produced by the hammer is increased. Conversely, for a given level of print force, the amount of coil release current can be reduced.

BRIEF DESCRIPTION OF THE DRAWINGS

The foregoing objects and many of the attendant advantages of this invention will become more readily appreciated as the same becomes better understood by reference to the following detailed description when taken in conjunction with the accompanying drawings wherein.

DESCRIPTION OF THE PREFERRED EMBODIMENT

Figure 1:
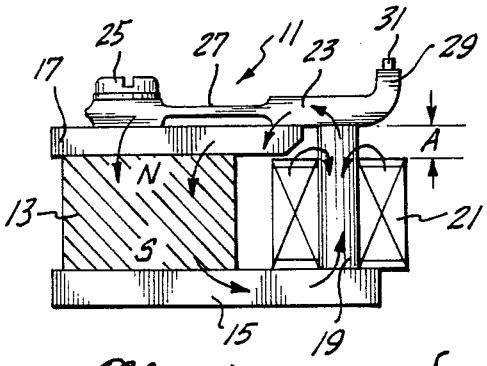
Fig. 1. (PRIOR ART)
FIG. 1 is a cross-sectional view of a prior art print hammer actuating mechanism.

FIG. 1 is a cross-sectional view of a prior art hammer actuating mechanism 11 of the type described in U.S. patent application Ser. No. 512,470. The actuation mechanism 11 illustrated in FIG. 1 comprises: a permanent magnet 13; a flux plate 15; a return plate 17; a post 19; a release coil 21; and a hammer 23. The flux plate 15, return plate 17, post 19 and hammer 23 are all formed of ferromagnetic materials.

The permanent magnet 13 has a rectangular, cross-sectional configuration. Mounted on one of the polarized faces of the permanent magnet 13 is the flux plate 15; and, mounted on the other polarized face is the return plate 17. The flux and return plates extend outwardly in the same direction beyond one edge of the permanent magnet 13. The flux plate 15 extends farther than the return plate 17. Mounted on the outer end of the flux plate 15 is the post 19. Mounted on the post 19 is the release coil 21. The post 19 lies beyond the outer end of the return plate 17 and terminates in a plane that is coincident with the plane defined by the outer face of the return plate 17. The length and size of the coil 21 is such that the coil lies between the facing surfaces of the flux and return plates 15 and 17 and such that the outer end of the return plate 17 overlies the release coil 21. As a result, the end of the coil 21 nearest to the tip of the post 19 is spaced from the tip by an amount approximately equal to the thickness of the return plate 17. This distance is denoted by the letter A in FIG. 1. In one actual embodiment of an actuating mechanism of the type illustrated in FIG. 1, distance A equaled approximately 0.11 inches.

The hammer 23 is cantilever mounted. More specifically, the hammer 23 is elongate and attached to the outer face of the return plate 17 where the return plate 17 overlies the permanent magnet 13. As illustrated, the hammer 23 is attached to the return plate 17 by a cap screw 25. The hammer 23 includes a thin center region 27 and a head 29. The head 29 overlies the outer end of the return plate 17 and the tip of the post 19. The outer end of the head 29 curves outwardly. Mounted on the outer tip of the head 29 is a print ball 31. Preferably, the print ball 31 is attached to the head 29 of the hammer 23 by welding.

When the actuating mechanism 11 is assembled in the manner illustrated in FIG. 1 and just described, the permanent magnet 13 creates a magnetic field (shown by the arrows) that pulls the head 29 tightly against the tip of the coil post and the outer face of the return plate 17. In the absence of the magnetic field produced by the permanent magnet 13, the head 29 would separate from the coil post tip and the end of the return plate 17 by a very small amount, preferably lying in the 16–20 thousandths of an inch range. When the permanent magnet pulls the head across the gap, against the coil post tip and the end of the return plate, the thin center region 27 of the hammer is stressed. When the thin region is so stressed, the hammer is in a cocked state.

The coil 21 mounted on the post 19 is energized in a manner that counteracts the magnetic field produced by the permanent magnet. That is, current is applied to the coil 21 in a direction that creates a magnetic field that counteracts the magnetic field produced by the permanent magnet 13 at the interface between; (i) the head 29 of the hammer 23; and, (ii) the tip of the post 19 and the end of the return plate 17. When a sufficient magnitude of current flows through the coil 21, the hammer 23 is released. Releasing the hammer 23 results in the energy stored in the stressed region 27 moving the head 29 of the hammer 23 and, thus, the ball 31 away from the coil post tip. This action results in the print ball 31 impacting a ribbon against a suitable print-receiving medium (e.g., paper) supported by a platen, neither of which are shown in the drawings. As a result, a dot is printed on the print-receiving medium. Current flow through the coil 21 ends as the hammer 23 rebounds from impact and the rebounding hammer 23 is recocked because the head region 29 is pulled back against the tip of the post 19 and the adjacent end of the return plate 17 by the magnetic field produced by the permanent magnet 13.

As will be readily appreciated by those familiar with magnetic circuits, the majority of the magnetic flux produced by the permanent magnet 13 follows a ferromagnetic circuit path defined by the flux plate 15, the post 19, the head 29, the hammer 23 and the return plate 17. A small amount of flux may follow a magnetic circuit path passing through the thin region 27 of the hammer 23. The amount of flux passing through the head 29 of the hammer 23 determines the magnitude of the attraction force that holds the head 29 tightly against the tip of the post 19 and the end of the return plate 17. Other magnetic flux, such as flux passing through the air between the flux and return plates 15 and 17 and flux passing through the air between the post 19 and the return plate 17, i.e., leakage flux, has no effect on the attraction force. Since only the flux passing through the interface between the head 29 and the tip of the coil post 19 creates the attraction force, the flux in this area needs to be counteracted by the magnetic field produced by current flow through the release coil 21.

As will be understood by those familiar with electromagnetic coils, the further a ferromagnetic object is away from a coil, the less magnetic force the coil applies to the object. The decrease in force with an increase in distance is a direct result of the fact that magnetic intensity rapidly decreases with increases in distance from a coil. In the case of an actuating mechanism of the type illustrated in FIG. 1, this means that the desired benefit of the magnetic field produced by the coil 21 is not maximized. More specifically, as illustrated in FIG. 1 and previously described, the distance between the end of the release coil 21 and the tip of the post 19, i.e., distance A, is substantially equal to the thickness of the return plate 17. As a result, as shown by the curved arrows located at the top of the release coil 21, a portion of the magnetic flux produced at the end of the coil 21 nearest to the interface between the head 29 and the tip of the post 19 does not pass through the interface. As a result, this magnetic flux has no cancellation effect on the permanent magnet flux passing through the interface. Because the effect of the coil across distance A is lost, the amount of flux that the coil 21 must produce in order to release the hammerhead 29 is higher than necessary. Because the amount of flux is higher than necessary, the current through the coil 21 is higher than necessary. Alternatively, the amount of drag force created by the permanent magnet flux after the hammer 23 is released is greater than it would be if the magnetic flux across distance A were effectively used to counteract the magnetic field produced by the permanent magnets. Since the coil current is higher than necessary to achieve a release of the hammerhead 29 for a prescribed amount of impact force, the heat generated by current flow through the coil 21 is higher than necessary. Depending upon the rate of hammer actuation and other relevant factors, coil generated heat can prematurely destroy a coil or require that coil cooling be added or increased in capacity. The present invention is directed to avoiding these disadvantages.

Figure 2:
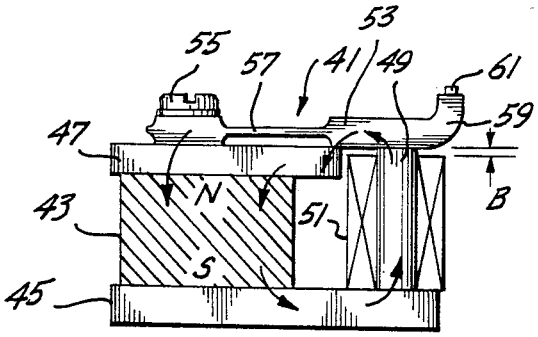
FIG. 2 is a cross-sectional view of a print hammer actuating mechanism formed in accordance with the invention; and, FIG. 3 is an exploded view of a preferred embodiment of a print hammer module incorporating print hammer actuating mechanisms formed in accordance with the invention.

FIG. 2 is a cross-sectional view of a hammer actuating mechanism 41 formed in accordance with the invention. As with FIG. 1, the hammer actuating mechanism 41 illustrated in FIG. 2 comprises: a permanent magnet 43; a flux plate 45; a return plate 47; a post 49; a release coil 51; and, a hammer 53. As with the prior structure illustrated in FIG. 1, the flux and return plates 45 and 47 are mounted on the oppositely polarized faces of the permanent magnet 43 and extend outwardly therefrom in the same direction. The flux plate 45 extends outwardly a substantially greater distance than the return plate 47. The post 49 is mounted on the outer end of the surface of the flux plate 45 that faces the return plate 47. The tip of the post 49 terminates in a plane lying substantially coplanar with the outer surface of the return plate 47. The release coil 51 is mounted on the post 49. However, rather than terminating just short of the facing surface of the return plate 47, the release coil 51 extends outwardly, terminating just short of the tip of the post 49. The distance between the tip of the post 49 and the end of the coil 51 is designated by the letter B in FIG. 2. Thus, distance B in FIG. 2 corresponds to distance A in FIG. 1. While it would be most desirable to make distance B equal to zero, a small post extension is necessary for tolerance requirements and because hammer retraction impact results in post tip wear. In one actual embodiment of the invention, distance B was equal to approximately 0.02 inches.

Also similar to FIG. 1, the hammer 53 illustrated in FIG. 2 is cantilever mounted. More specifically, the hammer 53 is mounted to the outer face of the return plate 47, in the region where the return plate 47 overlies the permanent magnet 43, by a cap screw 55. The hammer 53 includes a thin region 57 extending outwardly from the attachment region toward the post 49. Located on the end of the hammer 53 is a head 59. The head overlies the gap between the tip of the post 49 and the adjacent end of the return plate 47. Further, the head 59 curves outwardly and terminates in a flat region to which is welded a print ball 61.

As with the hammer actuation mechanism illustrated in FIG. 1, the permanent magnet 43 of the hammer actuation mechanism 41 illustrated in FIG. 2 pulls the head 59 tightly against the tip of the post 49 and the end of the return plate 47, whereby the head provides a bridge between these elements. In the absence of the magnetic field produced by the permanent magnet 43, the head 59 would separate from the tip of the post 49 and the outer end of the return plate 47 by a very small amount, preferably lying in the 16–20 thousandths of an inch range. When the permanent magnet 43 pulls the head 59 across this gap, against the tip of the coil post 49 and the outer end of the return plate 47, the thin region 57 of the hammer 53 is stressed and, thus, the hammer 53 is cocked.

When the coil 51 is energized and produces a magnetic field that counteracts the magnetic field created by the permanent magnet 43 in the manner described above, the hammer 53 is released. Release of the hammer 53 results in the energy stored in the stressed region 57 moving the head 59 of the hammer 53 and, thus, the ball 61 away from the coil post tip and creating a dot on a print-receiving medium in the same manner as the hammer actuating mechanism 11 illustrated in FIG. 1.

As will be readily appreciated from the foregoing description of FIGS. 1 and 2, the primary difference between the prior actuating mechanism (FIG. 1) and the actuation mechanism of the present invention (FIG. 2) is that the distance between the tip of the coil post and the adjacent end of the coil is substantially less. These distances are represented by the letters A and B in FIGS. 1 and 2, respectively. As previously described, in one actual embodiment of the actuating mechanism illustrated in FIG. 1, distance A was approximately equal to 0.11 inches. Contrariwise, in one actual embodiment of an actuating mechanism formed in accordance with the present invention (FIG. 2), distance B was equal to approximately 0.02 inches. The result of this distance decrease is an increase in the intensity of the magnetic flux created by the coil at the interface between the tip of the post and the head of the hammer for similar current level, coil turns, etc., parameters. In actual embodiments using coils with the same number of turns, carrying the same amount of current, an increase in hammer impact force falling in the range of 15–20 percent was measured. In this regard, as discussed above, the counteracting magnetic field produced by the release coil in both the FIG. 1 and FIG. 2 hammer actuating mechanisms does not entirely cancel the magnetic field, created by the permanent magnet at the interface, when the hammer is released. Rather, the permanent magnet field remains greater than the release coil field. This remaining field produces a drag force that slows the movement of the head of the hammer. Because the intensity of the magnetic flux produced at the interface by the release coil 51 of an actuating mechanism 41 of the type illustrated in FIG. 2 under similar conditions is greater than the intensity of the magnetic flux produced at the interface by a release coil 21 of an actuating mechanism 11 of the type illustrated in FIG. 1, the impact force of the FIG. 2 hammer 53 is greater than the impact force of the FIG. 1 hammer 23. Contrariwise, if an adequate impact force is present, the FIG. 2 actuating mechanism 41 allows coil current to be reduced while maintaining the impact force the same. In this instance, because the coil current is reduced, coil heat generation is reduced. Because coil heat is reduced, the amount of required cooling can be reduced and/or the speed of printing can be increased. Thus, there are trade-offs that allow the benefits of the invention to be utilized in different manners in different printers depending upon the result to be achieved.

Figure 3:
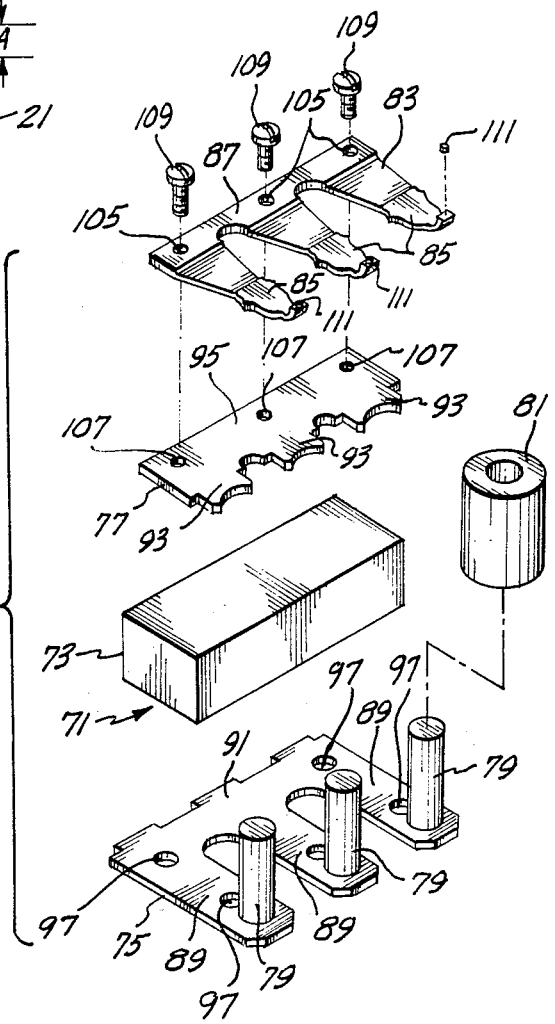

FIG. 3 illustrates a hammer bank module 71, similar to the hammer bank module illustrated and described in U.S. patent application Ser. No. 512,470, modified to incorporate the release coil configuration of the present invention. More specifically, FIG. 3 illustrates a hammer bank module 71 comprising; a permanent magnet 73; a flux plate 75; a return plate 77; a plurality of cylindrical coil posts 79; a plurality of release coils 81; and, a multi-arm hammer 83. The multi-arm hammer 83 includes three hammer arms 85 extending outwardly in a common plane from a base 87. Correspondingly, the illustrated flux plate 75 includes three arms 89 extending outwardly in a common plane from a base 91; and, the illustrated return plate 77 includes three arms 93 extending outwardly in a common plane from a base 95. Further, the number of coil posts 79 and release coils 81 illustrated in FIG. 3 is three (3). While the hammer module 71 is based on the multiple three (3), this multiple should not be construed as limiting, even though it is preferred. The multiple three (3) is preferred because it results in a conveniently sized module from a manufacturability viewpoint. Further, three (3) is divisible into sixty-six (66) and one hundred thirty-two (132), the preferred numbers of dot-printing elements included in dot matrix line printers designed to print a standard 132-character line.

The permanent magnet 73 is an elongate permanent magnet having the shape of a rectangular parallelepiped. The polarization of the permanent magnet is such that one pole (e.g., the north pole) of the magnet lies along one longitudinal face and the other pole (e.g., the south pole) lies along the opposed longitudinal base. Mounted on one of the polarized faces of the elongate permanent magnet 73 is the base 95 of the return plate 77; and, mounted on the other polarized face is the base 91 of the flux plate 75. Thus, the planar flux and return plates 75 and 77 lie in parallel planes. Further, the arms 89 and 93 of the flux and return plates 75 and 77 are formed and positioned such that they are aligned with one another.

The base 91 of the flux plate 75 includes two threaded holes 97 formed in each of the flux plate arms 89. Mounted on the outer end of each of the arms 89 of the flux plate 75 is one of the coil posts 79. The coil posts extend orthogonally outwardly from the plane of the flux plate 75 toward the return plate 77. The coil posts are attached to the arms, preferably by radially riveting the posts into holes in the arms 89. Mounted on each of the coil posts 79 is one of the release coils 81. The length of the release coils 81 is slightly less than the length of the coil posts 79 extending outwardly from the flux plate 75. When mounted on the posts 79, the ends of the coils 81 are, as previously noted, just short of the tips of the coil posts 79. Because the coils 81 cover substantially the entire length of the posts 79, they are herein sometimes referred to as long coils to distinguish them from the shorter coils 21 used in actuating mechanisms 11 of the type illustrated in FIG. 1.

Rather than attaching the flux plate 75 to the permanent magnet 73 and the permanent magnet 73 to the return plate 75 using bolts or some other clamping arrangement, preferably, these elements are adhesively bonded together.

As previously discussed with respect to FIG. 2, the lengths of the posts 79 are such that the outer surface of the tips of the posts 79 are coplanar with the outer surface of the arms 93 of the return plate 77. Preferably, this is accomplished by surface grinding the parts after they are assembled. While not magnetically necessary, as best seen in FIG. 3, preferably, the tips of the arms 93 of the return plate 77 located adjacent to the release coils 81 are curved such that a constant space gap is formed between the curved tips of the arms 93 and the adjacent peripheral surface of the release coils 81.

The base 87 of the multi-arm hammer 83 includes three holes 105, each aligned with one of the hammer arms 85. The multi-arm hammer 83 is positioned such that its base 87 overlies the base 95 of the return plate 77. When so positioned, the holes 105 in the base 87 of the multi-arm hammer 83 are aligned with three threaded holes 107 formed in the base 95 of the return plate 77. Screws 109 pass through the holes 105 formed in the base 87 of the multi-arm hammer 83 into the threaded holes 107 formed in the base 95 of the return plate 77. As a result, the base of the multi-arm hammer 83 is attached to the base 95 of the return plate 77. Print balls 111 are welded to the outwardly bent tips of the heads of the print arms 85.

As will be readily appreciated from the foregoing description, the invention provides an improved print hammer actuating mechanism, whether it be implemented in a print hammer module of the type illustrated in FIG. 3 or in a different form. More specifically, in accordance with the invention, a release coil is mounted as close as reasonably practical to the interface between a retracted hammer arm and the stop (e.g., the coil post), against which it is pulled by a retracting force (e.g., the magnetic field produced by a permanent magnet). Because of the close relationship, the amount of print impact force for a prescribed number of coil turns and current input is increased in an embodiment of the invention over what it is when a similar coil with a similar current input is spaced away from the interface. Alternatively, if an adequate impact force was previously provided, the amount of current necessary to achieve the same impact force can be decreased. Because current can be decreased, heat generation by the coils is correspondingly decreased. If an acceptable amount of heat was previously generated, speed can be increased because the coils can be pulsed more rapidly without increasing overall heat output. Consequently, the implementation of the invention can be tailored to achieve one of several results, depending upon the requirements of the mechanism in which the invention is to be used.

While a preferred embodiment of the invention has been illustrated and described, it will be appreciated that various changes can be made therein without departing from the spirit and scope of the invention. In this regard, it is not absolutely necessary that the release coil cover the entire length of the post. The contribution of each ampere-turn to hammer release decreases as the distance from the post tip increases. Another factor involved in a coil length decision is that total resistance and, hence, power dissipation increases with coil length. In other words, the coil length decision is a trade off between the decreased release benefits that occur as coil turns become farther and farther away from the tip of the coil post and the increase in resistance and power dissipation that occurs as coil length increases. If the post is short enough, as in the preferred embodiment of the invention heretofore disclosed, turns near the flux plate provide an adequate amount of release flux to justify a coil extending the length of the entire post. Such may not be the case in actuating mechanisms including longer posts. In such mechanisms, it may be desirable to terminate the coil prior to reaching the flux plate (or an equivalent part). The important item to note is that the coil should be positioned at the tip of the post and the coil should be sized to maximize the ampere-turns density near the post tip, commensurate with other design constraints such as coil resistance. Consequently, the invention can be practiced otherwise than as specifically described herein.

The embodiments of the invention in which an exclusive property or privilege is claimed are defined as follows:

1. In a hammer actuating mechanism comprising a magnetic circuit formed by a permanent magnet, a flux plate, a return plate, a post and a tubular shaped release coil, said flux plate mounted on one pole of said permanent magnet such that one surface of said flux plate faces said permanent magnet and said flux plate extends outwardly from said permanent magnet, said return plate mounted on the other pole of said permanent magnet such that one surface of said return plate faces said permanent magnet and said one surface of said flux plate and said return plate extends outwardly from said permanent magnet in the same direction as said flux plate, said return plate having an outwardly extending dimension less than the outwardly extending dimension of said flux plate, said post mounted on the end of said flux plate remote from said permanent magnet, said post extending toward said return plate, the end of said post remote from said flux plate lying coplanar with the surface of said return plate facing away from said permanent magnet, said tubular shaped release coil mounted on said post, said hammer actuating mechanism including a cantilevered hammer mounted on the surface of said return plate facing away from said permanent magnet at a point in alignment with said permanent magnet, said hammer including a narrow center region extending toward the end of said post remote from said flux plate and a head aligned with both the outer end of said return plate and the end of said post, the improvement comprising:

said tubular shaped release coil being mounted on said post such that one end of said tubular shaped release coil lies adjacent to, but slightly spaced from, the end of said post remote from said flux plate, said one end of said tubular shaped release coil being located a first distance from said flux plate, said one surface of said return plate which faces said permanent magnet being located a second distance from said flux plate, said first distance being greater than said second distance;

said return plate having an outer edge with a curved shape that corresponds to the curved configuration of the curved outer surface of said tubular shaped release coil; and, said return plate being positioned such that the outer edge of said return plate corresponding to the curved configuration of the curved outer surface of said tubular shaped release coil lies closely adjacent to, but spaced from, the curved outer surface of said tubular shaped release coil so as to surround a portion of said curved outer surface, the outer edge of said return plate having a first radius of curvature, the outer surface of said tubular shaped release coil having a second radius of curvature, said first radius of curvature being slightly greater than said second radius of curvature.

2. The improvement claimed in claim 1, wherein said tubular shaped release coil is substantially equal in length to the length of said post.

* * * * *